US005975288A

United States Patent [19]

Crowder et al.

[11] Patent Number: 5,975,288

[45] Date of Patent: Nov. 2, 1999

[54] HUMIDITY ALTERING DEVICE

[75] Inventors: Alan Byrd Crowder; Patrick Vincent Loung, both of Lompoc, Calif.

[73] Assignee: 49 Cigar, LLC, Lompoc, Calif.

[21] Appl. No.: 09/036,080

[22] Filed: Mar. 6, 1998

Related U.S. Application Data

[60] Provisional application No. 60/042,917, Mar. 28, 1997.

[51] Int. Cl.[6] ..... A24F 25/00; B65D 85/10

[52] U.S. Cl. ..... 206/205; 206/242; 239/53

[58] Field of Search ..... 206/242, 259, 206/205, 213.1; 239/53, 55, 56, 57

[56] References Cited

U.S. PATENT DOCUMENTS 3,801,011 4/1974 Guehler et al. .
3,924,807 12/1975 Morgan .
4,852,732 8/1989 Wilski et al. ..... 206/213.1 X
4,973,448 11/1990 Carlson et al. ..... 206/211.1 X
4,997,082 3/1991 Durocher .

*Primary Examiner*—Jacob K. Ackun
*Attorney, Agent, or Firm*—Lerner, David, Littenberg Krumholz & Mentlik, LLP

[57] ABSTRACT

A humidity altering device includes an impermeable housing confining a liquid absorbent element having a large capacity for holding a humectant liquid. The device is provided with at least one evaporation barrier which controls the rate of humectant liquid evaporation so as to maintain a predetermined level of relative humidity within a humidor for storage of various products, such as perishable foods and tobacco products, so as to maintain their freshness and desirability for extended periods of time.

30 Claims, 3 Drawing Sheets

HUMIDITY ALTERING DEVICE

This application claims the benefit of application Ser. No. 60/042,917 filed on Mar. 28, 1997, pursuant to 35 U.S.C. §119(e)(1).

BACKGROUND OF THE INVENTION

The present invention relates in general to a device for altering the degree of moisture in a designated storage space, and more particularly, to a humidity altering device for maintaining a specific humidity level in a humidor designed for the storage of humidity sensitive products.

A number of perishable commodities such as food products and tobacco products retain their optimum freshness and desirable properties when stored in environments in which a predetermined relative humidity is maintained. In addition, other products such as fabrics, rare books, drawings, paintings and the like require storage at specific relative humidity levels to reduce degradation and to prevent cracking and warpage.

The relative humidity in an enclosed generally airtight package can be controlled by providing a humectant, such as a water-based solution, within the package maintained in its liquid phase. The humectant liquid vaporizes in the package thereby producing water vapor. When the partial pressure of the water vapor is equal to the vapor pressure of the water for the humectant solution, an equilibrium is reached where the humectant gives off water vapor at the same rate as water vapor condenses back into the humectant liquid. Depending upon the equilibrium vapor pressure of the water over the humectant solution selected, a predetermined relative humidity may be established in the enclosed package.

It can be appreciated that it is important that the humectant solution be isolated from direct contact with the product being stored in the humidified environment. In this regard, there is known from Durocher, U.S. Pat. No. 4,997,082, a package having controlled humidity for storing humidity sensitive products such as tobacco and food products. The package is constructed as an enclosed container which stores a humidistat pad serving as a spacer, while also holding a humectant solution in its liquid phase in an absorbent interior layer. The pad is provided with a liquid impervious backing layer to protect the walls of the container from the liquid humectant solution. The pad also includes a liquid permeable cover which can rapidly transfer the humectant solution to the absorbent layer during filling of the package with the product to be stored. Also known was the use of a block of highly acetylized polyvinyl alcohol sponge material placed into a plastic bag having holes on opposing ends of the bag. The bag was confined within a housing having open ends opposing the holes in the bag. The bag was held in place within the housing using stainless steel screen material that was swedged into the open ends of the housing. Other known humidity altering devices are known from Morgan, U.S. Pat. No. 3,924,807 and Guehler et al., U.S. Pat. No. 3,801,011.

While the prior art discloses a number of humidity altering devices, there is the need for improvements in such devices so as to enable maintaining a specific humidity level in a humidor designed for the storage of humidity sensitive products.

SUMMARY OF THE INVENTION

It is an object of the present invention to provide a humidity altering device for maintaining specific humidity conditions in a container adapted for storage of various humidity sensitive products such as perishable food products, tobacco products and the like.

Another object of the present invention is to provide a humidity altering device which is capable of controlling humidity levels in a wide variety of storage volumes by altering the length of the device.

Another object of the present invention is to provide a humidity altering device which has increased humectant liquid storage capacity thereby minimizing its overall size for greater utilization of container space for stored products.

Another object of the present invention is to provide a humidity altering device which provides even humidification within a confined area without the use of costly chemical additives.

Another object of the present invention is to provide a humidity altering device which decreases the maintenance associated with short service intervals and chemical additives.

Another object of the present invention is to provide a humidity altering device which can be rapidly and economically changed in length, color and markings to serve a variety of applications.

In accordance with one embodiment of the present invention there is disclosed a humidity altering device comprising an impermeable housing having at least one opening therein, a liquid absorbent element adapted for absorbing a humectant liquid received within the housing, an evaporation barrier inserted within the opening of the housing, the barrier having an opening of predetermined size for controlling the evaporation rate of liquid from the element.

In accordance with another embodiment of the present invention there is disclosed a humidity altering device comprising a housing having impermeable walls and opposed open ends, a liquid absorbent element dimensioned to substantially fill the interior of the housing between the opposed open ends, the element adapted for absorbing a quantity of a humectant liquid for humidifying the air surrounding the housing upon evaporation thereof, an evaporation barrier releasably inserted within each of the opposed open ends of the housing thereby enclosing the interior of the housing, each barrier having an opening of predetermined size for controlling the evaporation rate of the liquid from the element into the air surrounding the housing, and a seal member on each barrier for creating a generally liquid tight seal between the barrier and an interior surface of the housing adjacent the opposed open ends by frictional engagement therebetween.

In accordance with another embodiment of the present invention there is disclosed a humidor containing a humidity altering device for storing tobacco products at a controlled humidity therein, the humidor comprising an openable container for storing a plurality of tobacco products therein; and a humidity altering device received within the container for controlling the humidity therein, the device comprising an impermeable housing having at least one opening therein, a liquid absorbent element adapted for absorbing a humectant liquid within the housing, and an evaporation barrier inserted within the opening of the housing, the barrier having an opening of predetermined size for controlling the evaporation rate of liquid from the element into the interior of the container for controlling the humidity therein.

BRIEF DESCRIPTION OF THE DRAWINGS

The above description, as well as further objects, features and advantages of the present invention will be more fully understood with reference to the following detailed description of a humidity altering device, when taken in conjunction with the accompanying drawings, wherein.

FIG., 1 is a perspective view of a humidor containing a humidity altering device constructed in accordance with one embodiment of the present invention.

DETAILED DESCRIPTION OF PREFERRED EMBODIMENTS

Figure 1:
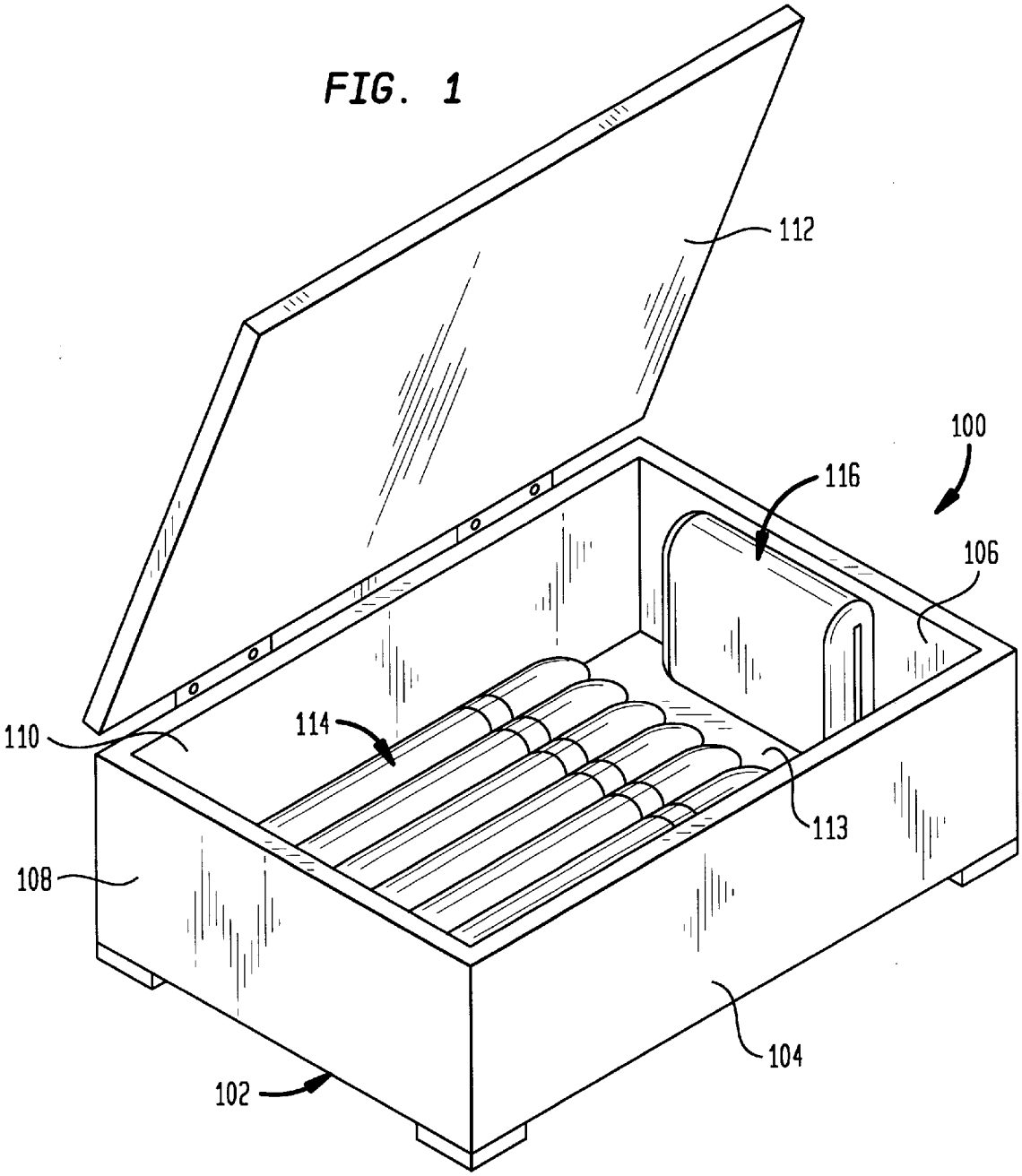

Referring now to the drawings wherein like reference numbers represent like elements, there is illustrated in FIG. 1 a humidor generally designated by reference number 100. The humidor 100 may be of any particular style, shape, size, configuration and the like, as is well known in the construction of humidors in general. By way of illustration only, the humidor is constructed from a container 102 of rectangular shape having four sidewalls 104, 106, 108, 110 providing an open top which is closed by a hinged cover 112 opposing a bottom wall 113. The humidor 100 can be constructed from a variety of materials, such as metal, plastic, wood, as well as composites of the aforementioned materials.

The interior of the humidor 100 is sized to accommodate a plurality of products 114 and at least one humidity altering device 116 which is constructed in accordance with the present invention. As previously noted, the products 114 may include perishable foods, tobacco products such as cigarettes and cigars as illustrated, as well as other humidity sensitive products such as rare books, manuscripts, various clothing items; and the like. Although the humidor 100 has been disclosed in FIG. 1 as illustrating storage of cigars, it is to be understood that the humidity altering device 116 may be used for any number of other products. In addition, the humidity altering device 116 is suitable for use in any particular style, construction or size of humidor 100 as to be explained hereinafter.

Turning now to FIGS. 2 through 5, one embodiment of at humidity altering device 116 will now be described. The humidity altering device 116 is generally constructed to include a housing 118, a liquid absorbent element 120 and at least one evaporation barrier 122. Optionally, the humidity altering device 116 may include an assembly 124 for releasably attaching the humidity altering device to an interior surface of the humidor 100.

The housing 118 is sized to accommodate the liquid absorbent element 120 having sufficient humectant liquid storage capacity for humidifying the humidor 100 of given size. The housing 118 is constructed from non-porous, impermeable materials such as plastic, ferrous metals, extruded aluminum which may be black anodized to enhance appearance, stainless steel, galvanized steel and the like. The interior and exterior surfaces of the housing 118 may also be coated with an electrodeposited polyurethane coating which additionally protects the housing when constructed of aluminum from corrosion, as well as providing a low-cost, decorative finish.

The housing 118 is generally constructed from a continuous imperforated wall 126 formed by extrusion which defines a hollow interior 128. However, the wall 126 may be formed from separate elements attached together in any suitable manner to define the interior 128. The housing 118, as illustrated, is provided with two open ends 130 having a shape conforming to the shape of the housing. As illustrated in the disclosed embodiment, the open ends 130 have an oval shape which, however, may also be square, circular, rectangular and the like. The open ends 130 provide openings 132 which are in communication with the interior 128 of the housing 118. Although the openings 132 have been described as provided at the ends of the housing 118, the housing ends may be closed and the openings 132 provided within the wall 126 of the housing. Any number of openings 132 may be provided within the housing 118. In this regard, the housing 118 as illustrated may be provided with only one open end 130, the other end being enclosed.

Each of the openings 132 are enclosed by the evaporation barrier 122. The evaporation barrier 122 is constructed from a body 134 of non-porous, impermeable material such as plastic, for example, rigid polystyrene, aluminum and the like. The body 134 is provided with at least one opening 136. Although the opening 136 has been illustrated as an elongated slot, it is to be understood that the opening may be in any form, for example, oval, circular, square and the like, as well as being multiple openings within each of the evaporation barriers 122. The openings 136 are suitably sized for controlling the evaporation rate of the humectant liquid absorbed in the liquid absorbent element 120 within the housing 118. In this regard, the larger the openings 136, the faster the evaporation rate of the humectant liquid, and accordingly, the ability to maintain a higher humidity level within the humidor 100. Generally, a relative humidity of about 60–70% is found suitable for use in humidors 100 for storing tobacco products such as cigars. As should now be understood, the evaporation barrier 122 is sized to permit a controlled flow of humectant vapor into the humidified space within the humidor 100, as well as allowing quick recharge of the liquid absorbent element 120 with the humectant liquid with no spillage, thereby requiring less maintenance and significantly prolonged humidity within the humidor.

The evaporation barrier 122 is secured within each of the openings 132 within the housing 118 by any suitable means. For example, it is contemplated that a suitable moisture resistant adhesive may be employed. Preferably, it is desirable that the evaporation barrier 122 be removable so as to facilitate replacement of the liquid absorbent element 120 if required, as well as eliminating the use of adhesives which are costly and add to the manufacturing process. In this regard, the evaporation barrier 122 is constructed to include a continuous shoulder 138 extending from the body 134 having a shape corresponding to the shape of the openings 132. The shoulder 138 is provided with an outwardly facing planar surface 140 which frictionally engages the interior surface of the housing 118 so as to provide a friction fit therebetween. By virtue of the friction fit, the evaporation barrier 122 is releasably retained within each of the opened ends 130 of the housing 118, while at the same time, providing a generally fluid tight seal thereat. Accordingly, it should be appreciated that the shoulder 138 functions as a seal member for generally sealing the evaporation barrier 122 within the open ends 130 of the housing 118 without the use of adhesives and the like.

Figure 6:
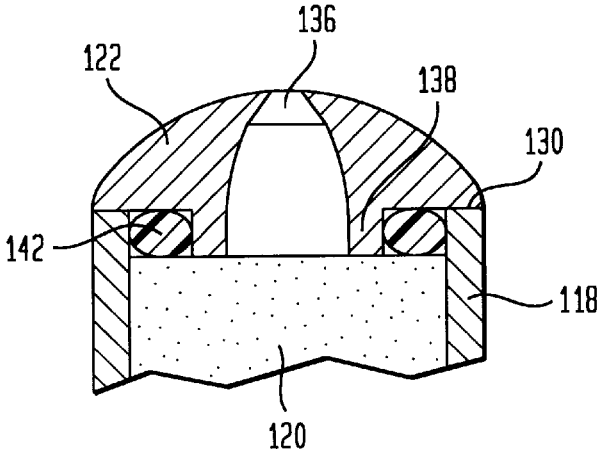
FIG. 6 is a cross-sectional view of an evaporation barrier constructed in accordance with another embodiment of the present invention.

In an alternative embodiment as shown in FIG. 6, the evaporation barrier 122 is provided with an O-ring 142 surrounding the exterior surface of the shoulder 138. In this regard, the shoulder 138 is spaced inwardly of the interior surface of the housing 118 to accommodate the O-ring 142. The O-ring 142 provides a fluid tight seal by being compressed between the outer surface 140 of the shoulder 138 and the interior surface of the housing 118 within the opened ends 130.

The liquid absorbent element 120 can be constructed from a variety of liquid absorbent materials which can be shaped so as to substantially fill the entire interior 128 of the housing 118. Preferably, the liquid absorbent element 120 will release the humectant liquid as a vapor at a constant rate over time by not drying out from the exterior surfaces inwardly. In addition, the liquid absorbent element 120 should resist the growth of odor causing mold and bacteria, while limiting the need for conditioning fluids. In the preferred embodiment, the liquid absorbent element 120 will be capable of retaining close to 100% of its available volume with the humectant liquid without oversaturation and drippage.

Although a number of synthetic foam materials are suitable for the liquid absorbent element 120, the element in accordance with the preferred embodiment is constructed from urethane foam material which has germicidal properties. Generally, the absorbent element 120 will have an average pore size of about 130 microns and an average porosity of about 92%. The aforementioned material for use as the liquid absorbent element 120 may be obtained from Hibco Plastics, Inc. of Yadkinville, N.C. (#151 Foam Rev. NS).

Another material suitable for use as the liquid absorbent element 120 comprises a highly acetylized polyvinyl alcohol sponge material, like the urethane foam material, having an average pore size of about 130 microns and an average porosity of about 92%. This material may be obtained from Shima America Corporation of Elmhurst, Ill. It is contemplated that other foam materials which have the capacity of absorbing a high weight percent of a liquid humectant, for example, water, and releasing same in the nature of a vapor are also suitable for use in the humidifying altering device 116 in accordance with the present invention.

Figure 2:
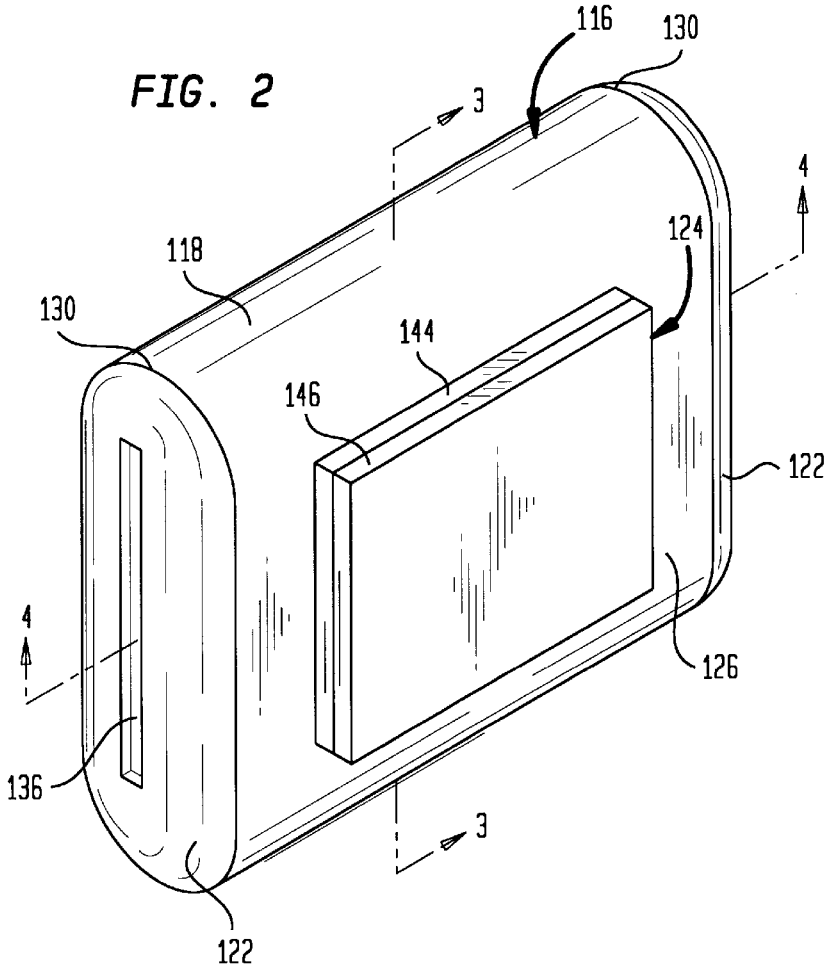
FIG. 2 is a perspective view of a humidity altering device constructed in accordance with one embodiment of the present invention.
Figure 3:
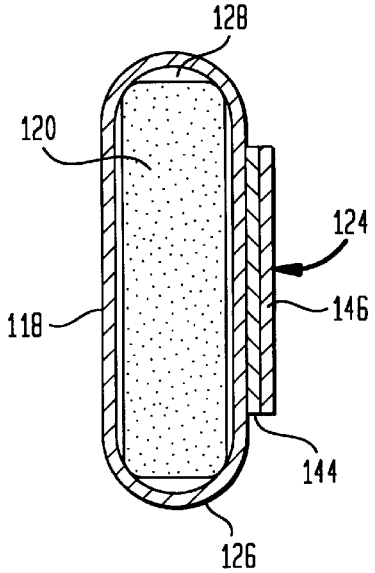
FIG. 3 is a cross-sectional view of the humidity altering device taken along Line 3—3 in FIG. 2.
Figure 4:
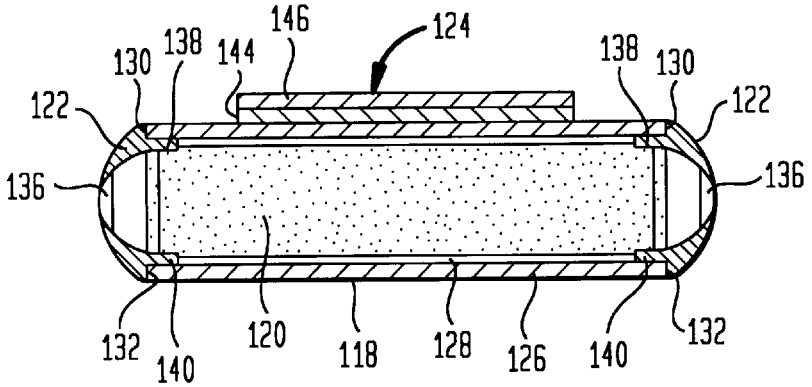
FIG. 4 is a cross-sectional view of the humidity altering device taken along Line 4—4 in FIG. 2.
Figure 5:
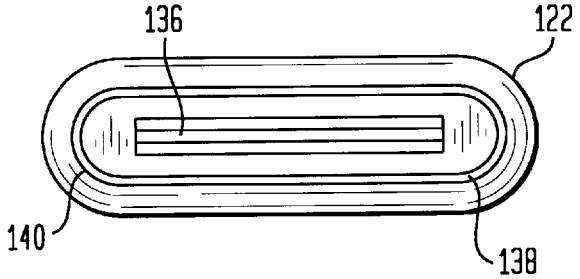
FIG. 5 is a bottom plan view of an evaporation barrier constructed in accordance with one embodiment of the present invention.

In use, the humidity altering device 116 is assembled as shown in FIG. 2 with the liquid absorbent element 120 filling the interior 128 of the housing 118. The liquid absorbent element 120 is saturated with water, and preferably deionized water to preclude mineral buildup, by immersing the device into a container of deionized water. Alternatively, one of the evaporation barriers 122 may be removed and the deionized water poured into the housing 118 so as to saturate the liquid absorbent element 120. In addition, it is also possible to pour the deionized water through one of the openings 136 within an evaporation barrier 122.

The humidity altering device 116 is operative to provide and maintain humidity necessary for storing and protecting perishables such as tobacco products, food products and other items such as fabrics and wood products. After a period of stabilization, the relative humidity within the humidor 100 will be controlled at a level of about 60–65%, and preferably about 70%. Because the liquid absorbent element 120 provides an extremely high capacity for humectant liquid, the device allows repeated opening of the humidor 100 and still provides the necessary level of relative humidity for an extended period of time, which is typically beyond the conventional refilling intervals of existing humidifying devices.

The humidity altering device 116 may be sized to provide the requisite relative humidity for a humidor 100 of given size. In this regard, the larger the volume of air space to be humidified, the larger the size of the humidity altering device 116 required. In this regard, by increasing the size of the humidity altering device 116, there is a corresponding increase in the size of the liquid absorbent element 120 which will enable a greater storage capacity for the liquid humectant. In addition, the size of the openings 136 within the evaporation barriers 122 may also be varied depending upon the size of the humidor 100. A particularly effective way of increasing the size of the humidity altering device 116 is to increase the length of the housing 118, along with a corresponding increase in length of the liquid absorbent element 120, and hence, its humectant liquid storage capacity.

The humidity altering device 116 may be removably attached to the interior surface of one of the sidewalls 104, 106, 108, 110 of the humidor 100 as shown in FIG. 1. Any suitable fastening assembly may be used for this purpose. By way of illustration, one such fastening assembly includes the combination of a disk magnet 144 and a ferrous plate 146. Either the magnet 144 or plate 146 may be attached such as using an adhesive to the outer surface of the housing 118. The other of the magnet 144 or plate 146 may be attached in a similar manner to the inner surface of one of the sidewalls 104, 106, 108, 110 of the humidor 100. In this manner, the humidity altering device 116 may be easily secured in removable fixed position to the interior of the humidor 100. Alternatively, the fastener assembly 124 may be constructed from cooperating Velcro material, as well as other suitable means for securing the humidity altering device 116 to the interior of the humidor 100.

Although the invention herein has been described with reference to particular embodiments, it is to be understood that the embodiments are merely illustrative of the principles and application of the present invention. It is therefore to be understood that numerous modifications may be made to the embodiments and that other arrangements may be devised without departing from the spirit and scope of the present invention as defined by the claims.

What is claimed is:

1. A humidity altering device comprising an impermeable housing having at least one opening therein, a liquid absorbent element adapted for absorbing a humectant liquid received within said housing, an evaporation barrier inserted within said opening of said housing, said barrier having an opening of predetermined size for controlling the evaporation rate of liquid from said element.

2. The humidity altering device of claim 1, further including a seal member for creating a seal between said barrier and said housing.

3. The humidity altering device of claim 2, wherein said seal member comprises a shoulder extending from said barrier frictionally engaging an interior surface of said housing adjacent said opening.

4. The humidity altering device of claim 1, wherein said element is dimensioned to substantially fill the interior of said housing.

5. The humidity altering device of claim 1, wherein said housing includes a pair of opposed ends, at least one of said ends containing said opening therein.

6. The humidity altering device of claim 5, further including another opening within the other of said ends of said housing, and another evaporation barrier releasably inserted within said another opening.

7. The humidity altering device of claim 1, further including means for releasably attaching said housing to a support therefore.

8. A humidity altering device comprising a housing having impermeable walls and opposed open ends, a liquid absorbent element dimensioned to substantially fill the interior of said housing between said opposed open ends, said element adapted for absorbing a quantity of a humectant liquid for humidifying the air surrounding said housing upon evaporation thereof, an evaporation barrier releasably inserted within each of said opposed open ends of said housing thereby enclosing the interior of said housing, each barrier having an opening of predetermined size for controlling the evaporation rate of said liquid from said element into the air surrounding said housing, and a seal member on each barrier for creating a generally liquid tight seal between said barrier and an interior surface of said housing adjacent said opposed open ends by frictional engagement therebetween.

9. The humidity altering device of claim 8, wherein said housing has an oval cross-section.

10. The humidity altering device of claim 8, wherein said element comprises urethane foam material.

11. The humidity altering device of claim 8, wherein said opening in each barrier comprises an elongated slot.

12. The humidity altering device of claim 8, wherein said seal member is integrally formed with said barrier.

13. The humidity altering device of claim 12, wherein said seal member comprises a shoulder extending outwardly from said barrier, said shoulder having an outer circumferential surface frictionally engaging the interior surface of said housing.

14. The humidity altering device of claim 8, further including means for releasably attaching said housing to a support therefore.

15. A humidor containing a humidity altering device for storing tobacco products at a controlled humidity therein, said humidor comprising an openable container for storing a plurality of tobacco products therein; and a humidity altering device received within said container for controlling the humidity therein, said device comprising an impermeable housing having at least one opening therein, a liquid absorbent element adapted for absorbing a humectant liquid within said housing, and an evaporation barrier inserted within said opening of said housing, said barrier having an opening of predetermirned size for controlling the evaporation rate of liquid from said element into the interior of said container for controlling the humidity therein.

16. The humidor of claim 15, further including a seal member for creating a seal between said barrier and said housing.

17. The humidor of claim 16, wherein said seal member comprises a shoulder extending from said barrier frictionally engaging an interior surface of said housing adjacent said opening.

18. The humidor of claim 17, wherein said shoulder is integrally formed with said barrier, said shoulder having an outer circumferential surface frictionally engaging the interior of said housing adjacent said opening within said housing.

19. The humidor of claim 16, wherein said seal member comprises an O-ring.

20. The humidor of claim 15, wherein said element is dimensioned to substantially fill the interior of said housing.

21. The humidor of claim 15, wherein said housing includes a pair of opposed ends, at least one of said ends containing said opening therein.

22. The humidor of claim 21, further including another opening within the other of said ends of said housing, and another evaporation barrier releasably inserted within said another opening.

23. The humidor of claim 15, wherein said opening within said barrier comprises an elongated slot.

24. The humidor of claim 15, further including means for releasably attaching said housing to an interior surface of said container.

25. The humidor of claim 24, wherein said means comprises the combination of a metal plate and a magnet.

26. The humidor of claim 15, wherein said housing has an oval cross-section and an pair of opposed open ends receiving a barrier therein.

27. The humidor of claim 15, wherein said element comprises urethane foam material, said material absorbing a quantity of a liquid for humidifying the air within the interior of said container.

28. The humidor of claim 15, further including a plurality of tobacco products within said container.

29. The humidor off claim 28, wherein said tobacco products comprise cigars.

30. The humidor of claim 15, wherein said barrier is releasably inserted within said opening of said housing.

* * * * *